US010779567B1

(12) United States Patent
Alexander

(10) Patent No.: US 10,779,567 B1
(45) Date of Patent: Sep. 22, 2020

(54) SMOKING PRODUCT HUMIDIFICATION APPARATUS AND METHOD

(71) Applicant: Austin Alexander, Los Angeles, CA (US)

(72) Inventor: Austin Alexander, Los Angeles, CA (US)

( * ) Notice: Subject to any disclaimer, the term of this patent is extended or adjusted under 35 U.S.C. 154(b) by 220 days.

(21) Appl. No.: 15/798,318

(22) Filed: Oct. 30, 2017

Related U.S. Application Data

(60) Provisional application No. 62/414,118, filed on Oct. 28, 2016.

(51) Int. Cl.
*A24F 25/02* (2006.01)
*A24F 15/18* (2006.01)

(52) U.S. Cl.
CPC ..... *A24F 25/02* (2013.01); *A24F 15/18* (2013.01)

(58) Field of Classification Search
CPC ..... A24F 25/00; A24F 25/02; A24F 15/18
USPC ..... 131/303
See application file for complete search history.

(56) References Cited

U.S. PATENT DOCUMENTS 3,346,135 A * 10/1967 Haitsch ..... B65D 51/26 215/227
5,556,579 A * 9/1996 Newman ..... A24F 25/02 239/59
5,816,264 A * 10/1998 Sebastiani ..... A24F 15/20 131/329
5,893,454 A * 4/1999 Hermanek ..... A24F 25/02 206/205
5,957,277 A * 9/1999 Elliott ..... A24F 25/02 206/205
5,957,380 A * 9/1999 Fitterman ..... A24F 25/02 239/53
2007/0163608 A1* 7/2007 Tarlow ..... A24F 15/20 131/240.1
2011/0067713 A1* 3/2011 Egued ..... A24F 15/12 131/250
2015/0201673 A1* 7/2015 Houmani ..... A24F 25/00 206/86

* cited by examiner

*Primary Examiner* — Michael H. Wilson
*Assistant Examiner* — Yana B Krinker
(74) *Attorney, Agent, or Firm* — Foundation Law Group LLP; J D Harriman

(57) ABSTRACT

A lid and sleeve system that creates a zero maintenance humidity controlled, protective environment within a cigar tube is disclosed. This invention incorporates two-way humidity control technology while adding superior protection as well as optimal air circulation in an optionally transparent tube, designed for but not limited to the disposable retail packaging of a cigar.

16 Claims, 18 Drawing Sheets

SMOKING PRODUCT HUMIDIFICATION APPARATUS AND METHOD

RELATED APPLICATION

This application claims the benefit of U.S. Provisional Application Ser. No. 62/414,118 filed on Oct. 28, 2016, the entirety of which is incorporated herein by reference

FIELD OF THE INVENTION

The invention relates generally to the field of smoking product packaging and accessories.

BACKGROUND

Cigar storage humidity control can be found in US published patent applications; US 2015/0201673; US 2012/0031780; US 2008/0245685 and in US issued patents; U.S. Pat. Nos. 8,342,185; 5,957,277; 5,957,380; 5,893,454; 6,298,857; 5,816,264; 5,936,178; 3,771,535; 2,911,983; 2,296,830; 1,997,629; 1,699,090; 1,619,306; 1,366,283 5,749,461; 6,279,581; 8,602,210, The content of all of the foregoing published applications and patents is incorporated herein by reference. Other content can be found in US published applications US 2015/0021217; and US 2015/0328584; and in US issued U.S. Pat. Nos. 8,540,075; 8,087,645; 7,565,969; 6,157,306; 6,157,306; 6,006,903; 5,881,868; 5,829,581; 5,535,763; 5,277,315; 5,277,315; 5,037,459; 5,011,009; 4,930,526; 3,137,303; 2,740,683. The content of all of the foregoing published applications and patents is incorporated herein by reference.

BRIEF DESCRIPTION OF THE DRAWINGS

FIG. 5*b* is a top view of the upper locating member.

FIG. 6*g*-1 is a cross section view of an alternative winged lower locating member or stabilizing disc ready for lower of the smoking product FIG. 6*g*-2 is a cross section view of an alternative winged lower locating member or stabilizing disc with the smoking product in place

DETAILED DESCRIPTION

Figure 1:
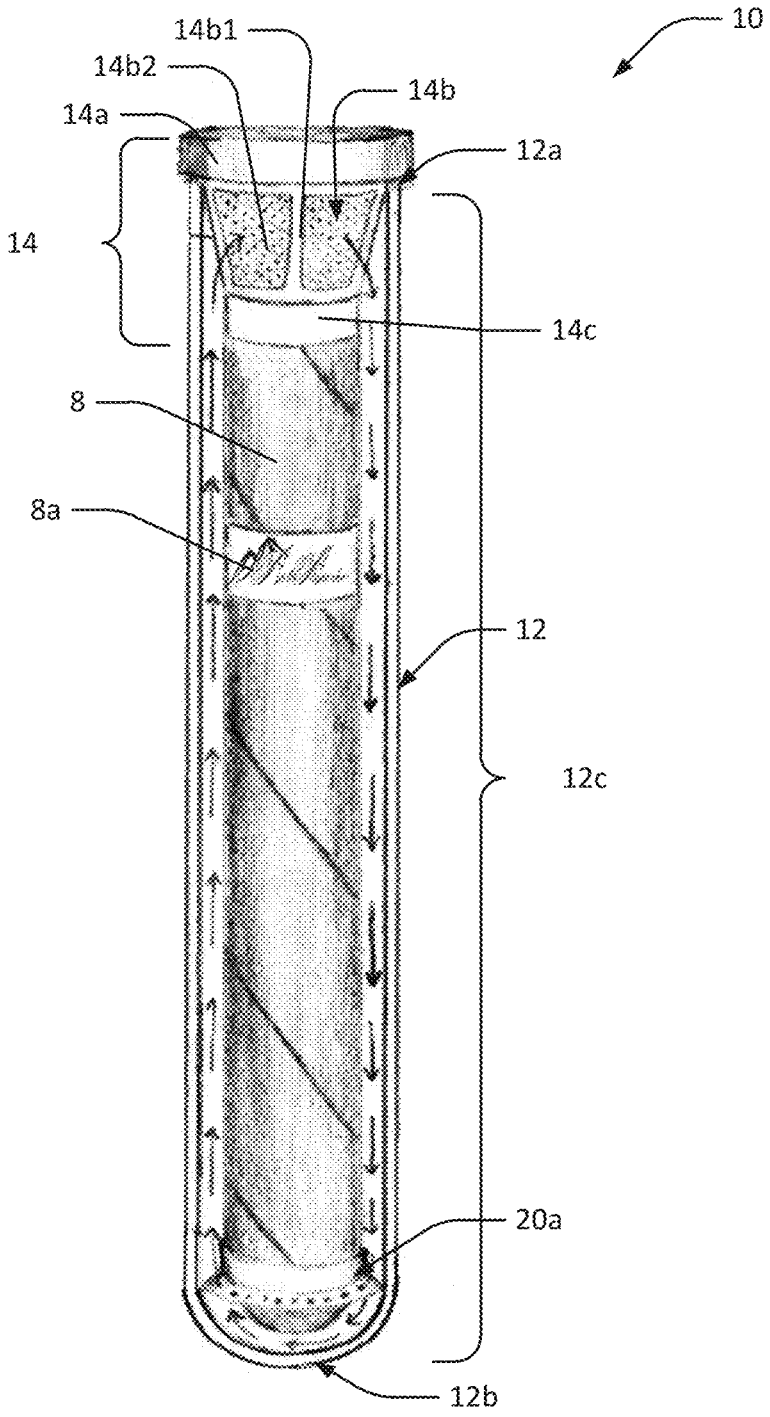
FIG. 1 is an assembled view of the smoking product humidifying apparatus with a cigar in the storage position.

Maintaining the humidity of a storage vessel for smoking products such as cigars is important for preserving the quality of stored cigars. Disclosed and described herein is a humidity controlled smoking product containing apparatus and a method of providing humidity control for a smoking product. The described embodiments present a low-cost, zero-maintenance, lid & sleeve system which provides a humidity controlled, protective tube for storing or packaging smoking products including cigars suspended within the tube.

While the following description uses the context of cigars as the product being protected, it is understood that the description is applicable to all smoking products of the type having an elongated cylindrical exterior surface with a burning end and an inhaling end.

The apparatus as described keeps the cigar centrally located within the tube so that the circulation space around it is uniform thereby allowing controlled continuous flow of the humidity preserving gas and also protecting the cigar from damage such as may be caused by transporting or simply a user carrying it. This is done by holding the cigar in a central position inside the tube by a holding means at each end of the cigar and where the holding means are carefully shaped to accept the shape of the cigar sufficiently holding it steady but preventing damage to the cigar. It is also noted that in the cigar world per se, collecting and preserving is a business and hobby. The present descriptions allow for protection of cigar bands, the presence and quality condition of which are important to the value of collectable cigars. Also, in that context, marketing benefit is obtained by attractive visual access to the cigar, rather than covering it with packing material. Such packing material is usually made of plastic foam or compressible organic material and commonly inserted into cigar tubes between the cap and cigar to immobilize the smoking product. It is physically obstructive and annoying for consumers to remove said packing material in order to access the cigar. Said packing material is also visually intrusive, which affects optimal visual comprehension and overall marketability of the entire smoking product. Retailers commonly use this packing material to immobilize the cigar, which protects the cigar from internal impact with the tube. It also prevents the cigar band from becoming dislocated from the manufacture's originally intended positioning.

Currently available disposable cigar tubes do not maintain a zero-maintenance humidity controlled environment. In a low humidity environment cigar tobacco will dry out and the quality of the cigar will deteriorate. Two-way humidity control packets have been developed by Boveda Manufacturing Company of Minnetonka, Minn. These packets cannot be simply inserted inside a cigar tube with a cigar, as the cigar itself would stifle the humidity controlled air by blocking its consistent circulation inside such a tight space. The packet could also become easily stuck inside the tube, damaging the fragile cigar material with internal impact such as by crushing the packet against the cigar. The unsightly Boveda packet also detracts from the marketing of cigars when presenting cigars in clear tube packages.

Available humidor equipped tubes are not designed to be disposable, they do not incorporate maintenance free 2-way humidity control technology and they do not suspend cigars in a centralized position. In contrast the disclosed storage tube suspension system not only optimally protects the cigar but also allows even circulation of humidity controlled air to constantly flow around the entire cigar.

If one were to simply place a 2-way humidity control packet inside of a standard cigar tube it could easily become stuck, inhibit air circulation, make for poor visual marketing and pose a threat of physical damage to the delicate cigar material, via free floating internal impact. The only currently available disposable retail cigar packaging that does incorporate 2-way humidity control technology comes in the form of a foil-lined sealed plastic bag that holds a free floating cigar and free floating humidity control packet inside the pouch together. That system offers inconsistent airflow and inadequate protection of the cigar itself, from both internal & external impacts, while eliminating visual comprehension, thus limiting the cigar's overall marketability. The present invention provides superior protection and optimal air circulation in an optionally transparent tube, designed for but not limited to the disposable retail packaging of a cigar.

As stated above, disposable cigar tubes do not maintain a zero maintenance humidity controlled environment, so that they lead to a dry and depreciated product. An effective two-way humidity control technology are the packets made by Boveda. however, these packets cannot be simply inserted inside a cigar tube with a cigar, as the cigar itself would stifle the humidity controlled air by blocking its consistent circulation inside such a tight space. Also, the packet could also become easily stuck inside the tube and or damage the fragile cigar material with internal impact between the packet and the cigar itself. The packet also interferes with the marketing presentation of the cigar if used within a clear tube. The disclosed invention described and claimed here solves this problem.

As described below in more detail with respect to the drawings the present cigar humidity control apparatus has a tube for containing a cigar.

In the disclosed invention, a sealing lid has an attached tapered chamber, which contains two-way humidity control technology. A small circular upper locating member (also referred to as a upper locating member) attached to the bottom of the humidity chamber, slips over the tip of the cigar, keeping it in place on the top, while at the bottom of the tube; there is another stabilizing disk and sleeve component, which holds the opposite end of the cigar securely at the center, in line with the top sleeve. Downward pressure created by sealing the lid pushes these two centralized holding points closer together enough to not crush but centrally immobilize the cigar and suspend it within the tube. The tube circumference itself is larger than the cigar and the tapered humidity control chamber, allowing two-way humidity controlled air to consistently circulate around the entire surface area of the centrally suspended cigar. No currently available system evenly controls the humidification of a cigar with zero maintenance, in a disposable cigar tube; utilizing off-the-shelf two-way humidification packets. Current use of the packets is problematic as the packets may easily become stuck inside of cigar tubes and detract from visual aspects of marketing. Current use of these packets inside cigar tubes may damage the delicate cigar material via free floating impact between the packet and the cigar itself. The current invention allows for even humidification while eliminating the obstacle of packet removal as well as the packet's unappealing visual aesthetic, and securely protects the cigar from any potential internal impact from the packet and tube walls. The current invention also effectively immobilizes the cigar, which alleviates the need for retailers to insert packing materials into the tube between the cap and the cigar. Such packing material is usually made of plastic foam or compressible organic material. It is physically obstructive and annoying for consumers to remove said packing material in order to access the cigar. Packing is also visually intrusive, which effects optimal visual comprehension and overall marketability of the entire smoking product. Retailers commonly use this packing material to immobilize the cigar, which protects the cigar from internal impact with the tube. It also prevents the cigar band from becoming dislocated from its originally intended position.

Available humidor tubes are not designed to be disposable, and they do not provide maintenance free two-way humidity control technology, while suspending cigars in a centralized position. The only currently available disposable retail cigar packaging that does incorporate two-way humidity control technology comes in the form of a foil-lined sealed plastic bag that holds a free floating cigar and free floating humidity control packet inside the pouch together. This foil bag system suffers from inconsistent airflow and inadequate protection of the cigar itself from both internal and external impacts. The foil bag system also prevents viewing the cigar, limiting the overall marketability.

Available humidor tubes are typically bulky and utilize sponges that need to be constantly maintained by the user, leading to inconstant humidity levels and no chance for the functional application of a humidity controlled retail shelf-life environment, which would be optimal for a pre-packaged cigar. The foil-lined, plastic sealed bag utilizing 2-way humidity control technology inadequately protects the delicate cigar from internal impact with the humidity control packet as well as from external impacts and both systems shroud the cigar itself, limiting its overall marketability.

Various embodiments of the current disclosed invention provide a disposable storage or packaging system for cigars in an optionally transparent tube with air circulation optimized two-way humidity control, physical protection of the cigar and an optional incorporated cutting tool. The miniature incorporated cigar cutter that fits in a cigar tube in an embodiment with a modified version of the stabilizing disk and sleeve component as shown in the drawings to be described below.

Various embodiments of the cigar humidifying apparatus are described here by a description of the drawings and the identified parts of the apparatus.

FIG. 1 shows a side view of the humidity controlled smoking product containing apparatus 10 with a cigar 8 with cigar band 8*a* stored by the apparatus. The humidity controlled smoking product containing apparatus is constructed of the tube 12, a sealing lid assembly 14, and a stabilizing disc 20*a* (also referred to as the lower locating member) the shown embodiment having an upright sleeve. The sealing lid assembly 14 is constructed of a sealing cap 14*a* and a breathable humidity control chamber assembly 14*b*. The sealing cap 14*a* may be constructed of plastic and may be threaded or non-threaded. Attached to the inside of the sealing cap 14*a* is the breathable humidity control chamber assembly 14*b* which is formed by frame 14*b*1 and a in one embodiment a tapered, plastic mesh 14*b*2 to allow flow of humidified gas. The breathable humidity control chamber 14*b* has an upper circular opening 14*b*3 at the top defined by a circular upper frame rim 14*b*4 and a lower circular opening 14*b*5 at the bottom defined by a circular lower frame rim 14*b*6 at the bottom and has a tapered open area between ribs 14*b*7 which therefore allow the open area to be covered by a mesh. The diameter of the lower circular opening 14*b*4 at the bottom is significantly smaller than the sealing cap 14*a* and is closed at the bottom by the chamber upper locating member 14*c*. The chamber upper locating member 14*c* is removably fitted to the bottom of the breathable humidity control chamber 14*b* such as by friction or interference fit into the circular lower frame rim 14*b*6. As can be seen, because the breathable humidity control chamber 14*b* is tapered in form from its top to its bottom, the full area of its open sides is available for flow of the humidifying gas into the tube. See FIG. 3*b* for a detailed diagram of the sealing lid assembly 14.

Near the bottom of the tube 12*b* is the stabilizing disc with upright sleeve 20*a*. The cigar 8 (with cigar band 8*a*) is positioned for storage or packaging between the upper locating member 14*b*3 near the top of the tube 12*a* and the stabilizing disc with upright sleeve 20*a* near the bottom of the tube 12*b*. Humidity control packets 16 as exemplified by the Boveda packets, are contained within the breathable humidity control chamber 14*b*. As shown by the arrows in FIG. 1, correctly humidified air is allowed to circulate around the entire cigar 8 to optimally preserve the tobacco or organic material composing the cigar. Although the arrows show flow down on one side and up on the other in FIG. 1, the actual flow will be in the nature of randomized flow.

Figure 2:
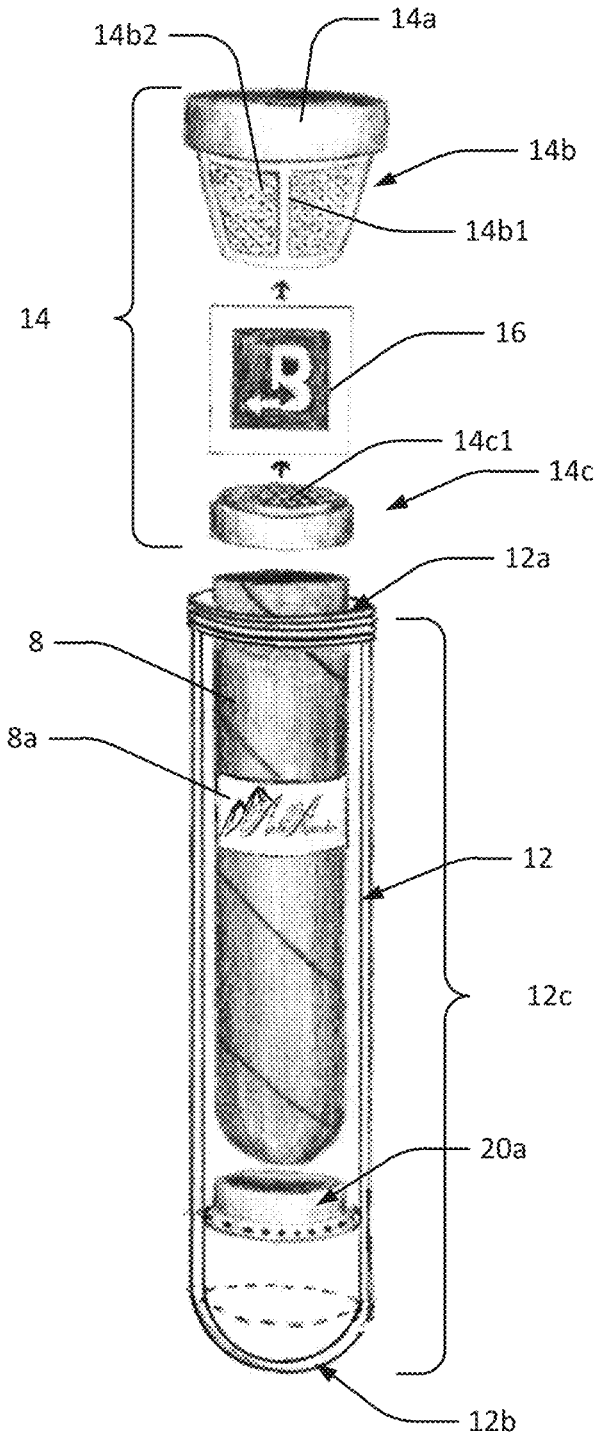
FIG. 2 is a view of the cigar humidifying apparatus with the sealing lid assembly disassembled.

FIG. 2 shows a partially exploded view of the humidity controlled smoking product containing apparatus 10. This figure shows how the various assemblies and parts as described above fit together. At the top, the sealing lid assembly 14 with the breathable humidity control chamber 14*b* contains the humidity control packet 16 which is held in the breathable humidity control chamber by the chamber upper locating member 14*c*. The humidity control packets are typically a water vapor permeable pouch and a thickened saturated salt solution, the Boveda product being exemplary. A cigar 8 with cigar band fits into the bottom of the chamber upper locating member 14*c*, centering it within the tube 12. The full sealing lid assembly 14 fits into the top of the tube 12*a*. The cigar 8 fits into the stabilizing disc with upright sleeve 20*a*, located near the bottom of the tube 12*b*. The sealing lid assembly 14 may be snapped onto the top of the tube 12 or threaded onto the tube 12 or they may be ribbed for fit, in alternate embodiments, the closure being effective as a hermetic sealing of the entire interior of the tube. To assembly the apparatus with a cigar in place, the cigar is positioned onto the lower stabilizing disc and then the sealing lid assembly 14 is applied to the top of the cigar and tube (which is sized according to a particular cigar). As the lid seals against the top of the tube, the cigar is fixed between the cap sleeve and stabilizing disc, suspending it with almost its entire surface exposed to the humidifying air and is protected from physical damage within the tube. Suspending the smoking product between the upper locating member and stabilizing disc also protects it from any movement, which in the case of a cigar would assist in keeping the cigar band in place during shipping and general movement of the packaging. Suspending the cigar between the upper locating member and the stabilizing disc not only physically protects the smoking product from damage incurred internal impact with the tube walls but it also replaces the need for manufacturers or retailers to stuff their tubes with less than desirable packing materials in order the to keep the cigar band in place.

Figure 3A:
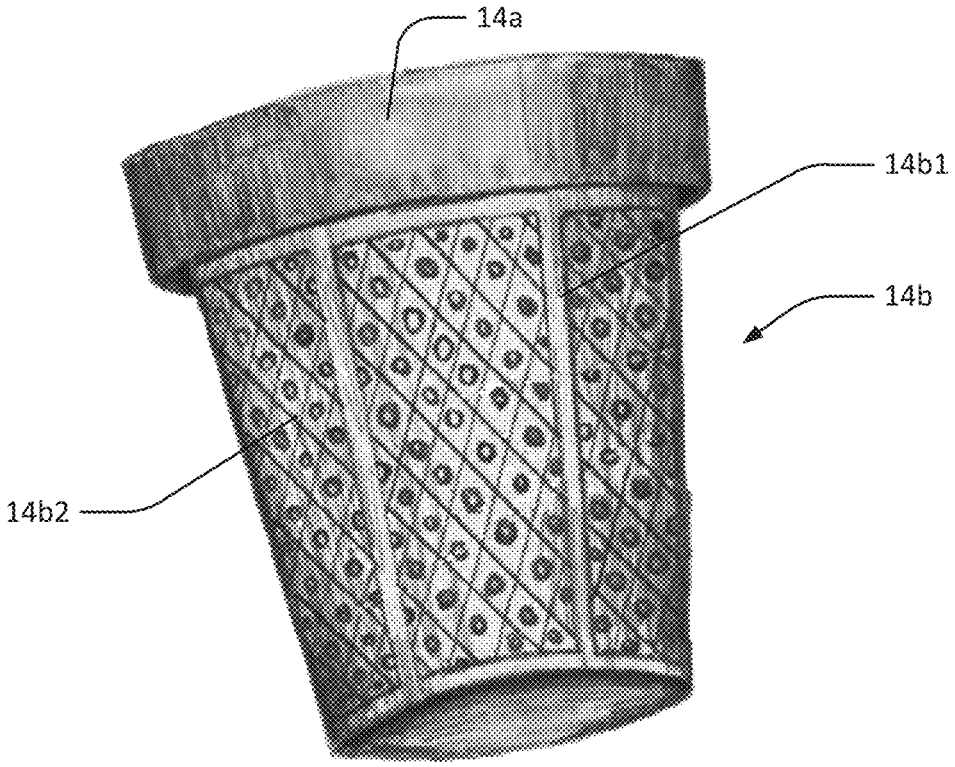
FIG. 3*a* depicts the humidity control chamber assembly.
Figure 3B:
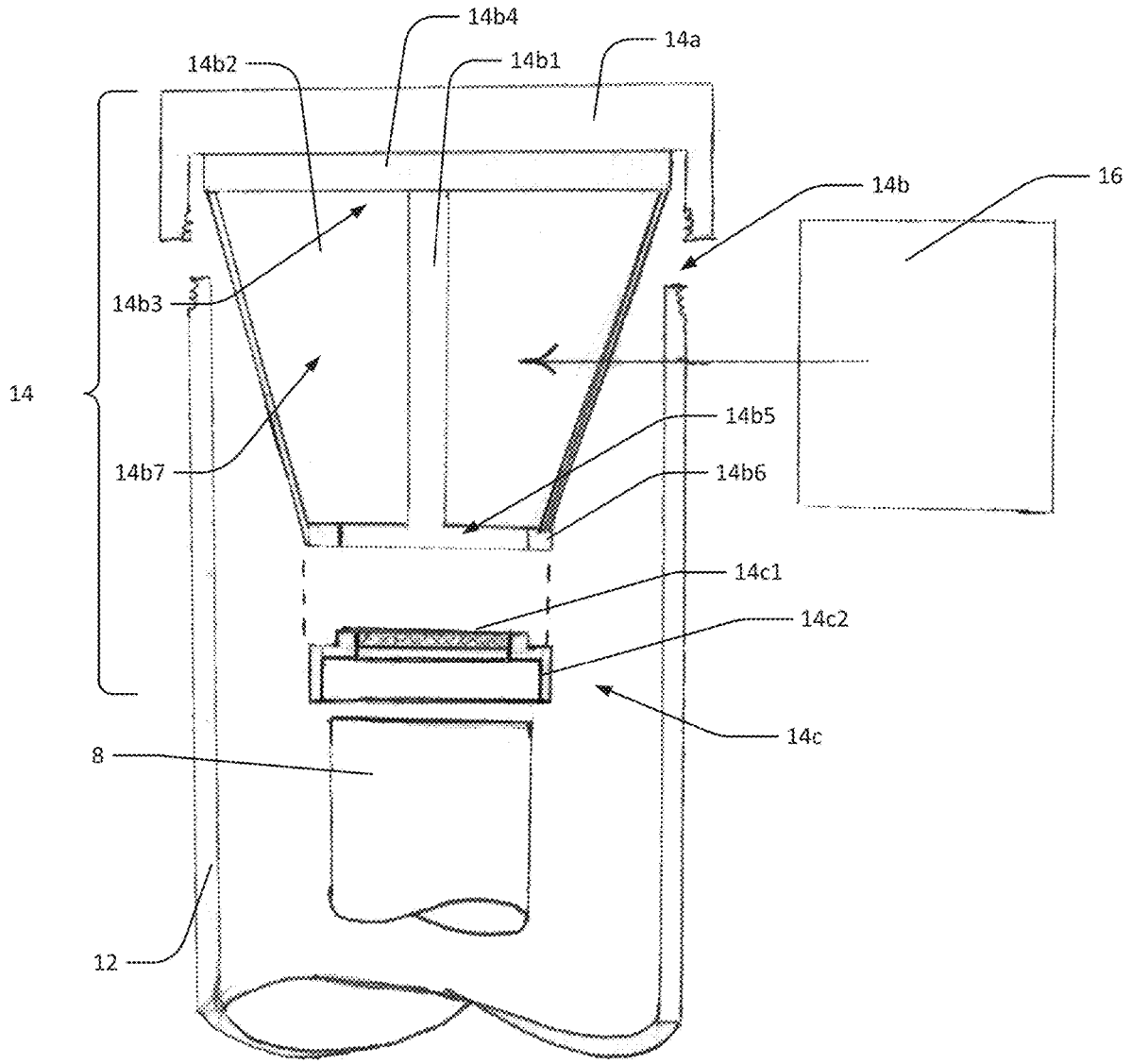
FIG. 3*b* is a cross section view of the sealing lid assembly.

FIGS. 3*a* and 3*b* show details of the sealing cap assembly. In FIG. 3*a*, the sealing cap 14*a* and the breathable humidity control chamber 14*b* is shown. The breathable humidity control chamber 14*b* is constructed of a mesh 14*b*1 which may be a plastic mesh. a, a woven thread mesh, or a metallic mesh. The breathable chamber may also include a frame or structural ribs 14*b*2 which provide a strengthening structure for the chamber walls. Instead of a mesh being integral to the structure of the breathable humidity control chamber 14*b*, it may be provided by a paper or other mesh fitted around the interior of the humidity control chamber frame.

FIG. 3*b* shows a cross section of the sealing lid assembly 14, demonstrating how the various components fit together. The sealing cap 14*a* of the assembly fits into the top of the cigar tube 12*a* snuggly to form a seal and as downwardly fitted to securely but gently fit the cigar in place. Shown in the cross-sectional diagram, the breathable humidity control chamber 14*b* with frame or structural ribs 14*b*1, mesh 14*b*2 and chamber upper locating member 14*c* which closes the bottom of the chamber and holds the cut end of the cigar. Shown is the cap portion 14

Figure 3C:
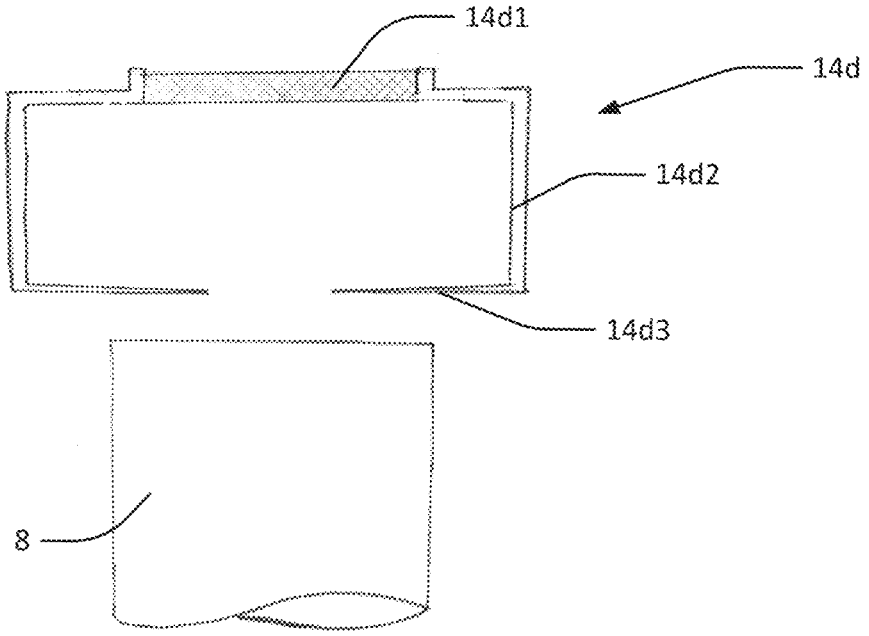
FIG. 3*c* is a cross section view of an alternative embodiment of the upper locating member using a winged receiving cap.
Figure 3D:
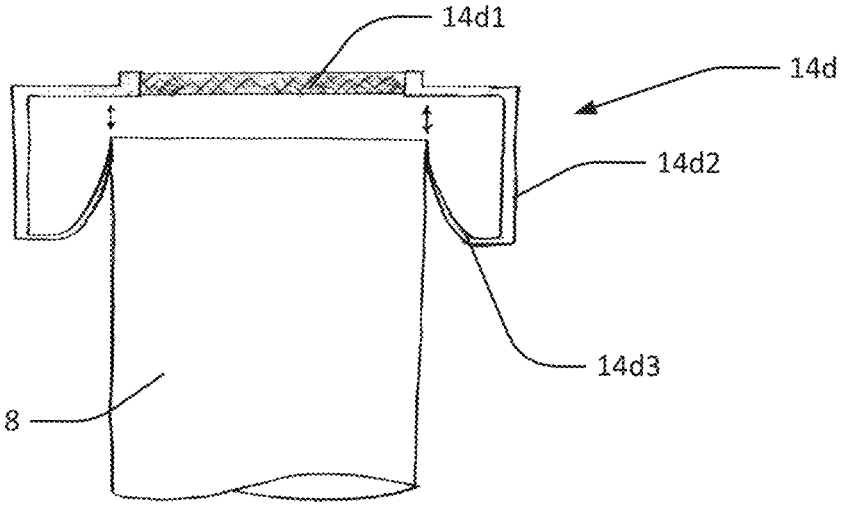
FIG. 3*d* is a cross section view of an alternative embodiment of the upper locating member using a winged receiving cap shown with a received cigar.

FIGS. 3*c* and 3*d* show an alternate embodiment of the chamber upper locating member 14*b*4 using a winged receiving cap to be further described below. FIG. 3*c* shows a cross section view of the winged receiving cap 14*d* prior to the cigar 8 placement. The components of the winged receiving cap 14*d* include the top mesh 14*d*1, the sleeve 14*d*2 and the receiving wings 14*d*3. FIG. 3*d* shows a cross section view of the winged receiving cap 14*d* after the cigar 8 is received by the cap. The components of the winged receiving cap 14*d* include the top mesh 14*d*1, the sleeve 14*d*2 and the receiving wings 14*d*3. As can be seen, the flexible wings bend inward as the cigar 8 is received, forming holding and centering the cigar.

Figure 4:
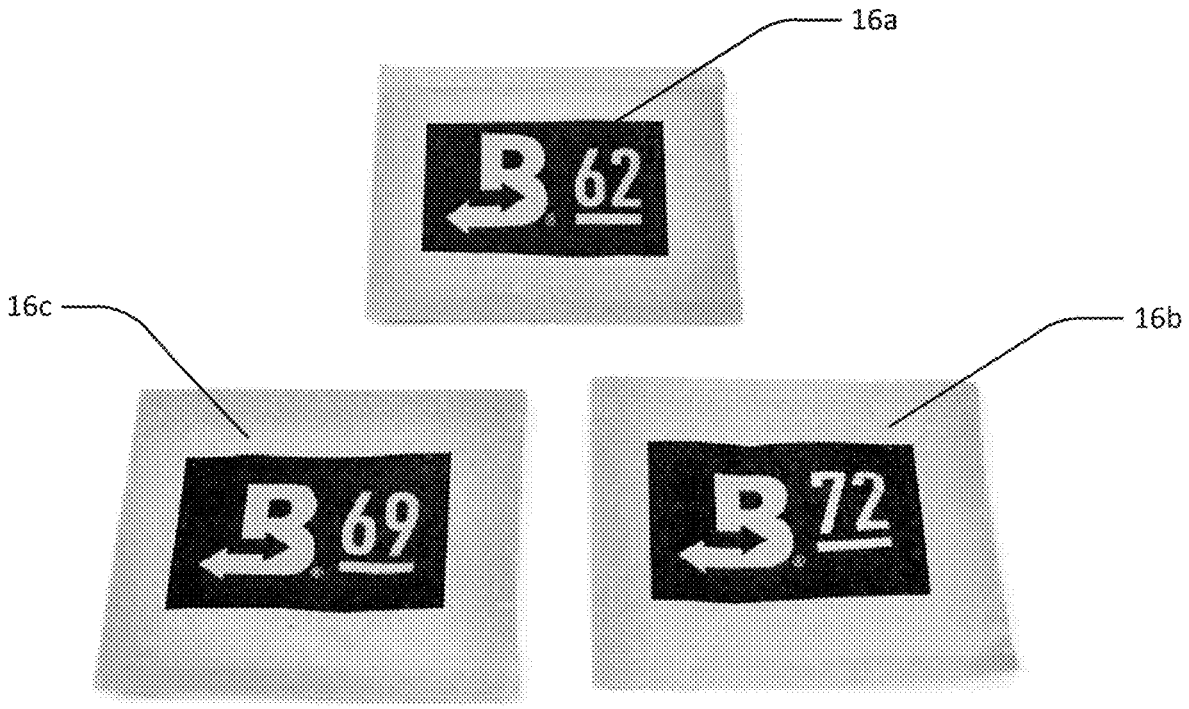
Prior Art Figure 4
FIG. 4 shows 3 versions of the Boveda humidity control packets.

FIG. 4 shows images of 3 exemplar Boveda 2-way humidity control packets. The shown packets are marketed by Boveda and as marked, these exemplar packets are designed to maintain the relative humidity at 62% (16*a*) 69% (16*b*) and 72% (16*c*) by either absorbing excess moisture or releasing moisture as needed to maintain the desired level of humidity. Different strains of organic material composing the cigar, including tobacco strains, may be optimally preserved by different humidity control packets.

Figure 5A:
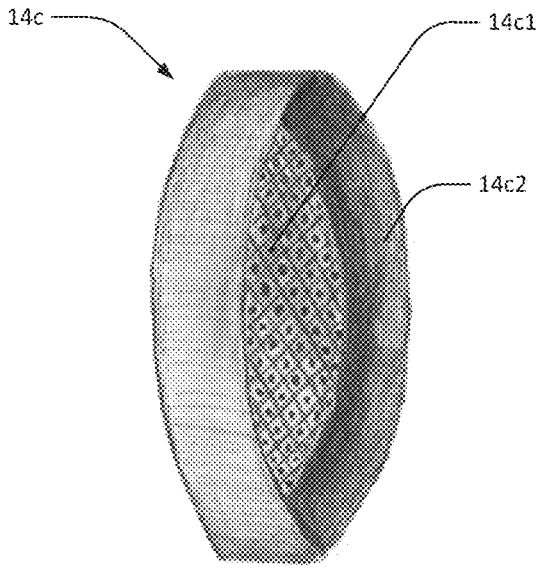
FIG. 5*a* is a side view of an embodiment of the upper locating member looking in from below
Figure 5C:
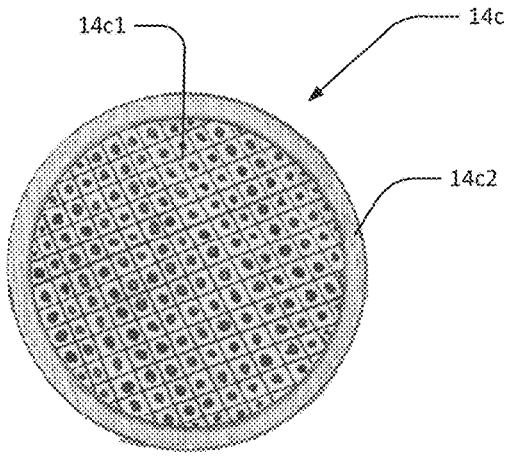
FIG. 5*c* is a top view of an embodiment of the upper locating member.
Figure 5B:
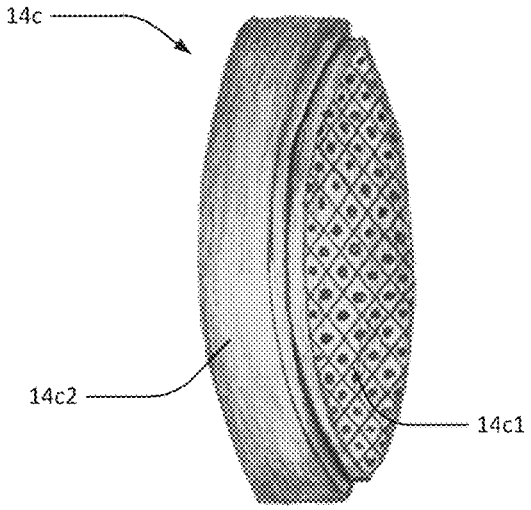
FIG. 5*b* is a side view of an embodiment of the upper locating member looking in from above.

FIGS. 5*a*-5*d* show depictions of 2 embodiments of the chamber upper locating member 14*c*. The central portion of each version is a mesh 14*c*1. FIGS. 5*a*, 5*b* and 5*c* show an embodiment of the upper locating member 14*b*3 allowing the cut end of the cigar to be held inside the sleeve element 14*c*2. FIG. 5*a* shows a side perspective view of the upper locating member 14*c* of the inside of the cap revealed. FIG. 5*b* shows a side perspective view of the upper locating member 14*c* of the inside of the cap revealed. Shown are the mesh 14*c*1 and sleeve 14*c*2 elements. FIG. 5*c* shows a bottom view of the upper locating member 14*c*.

Figure 5D:
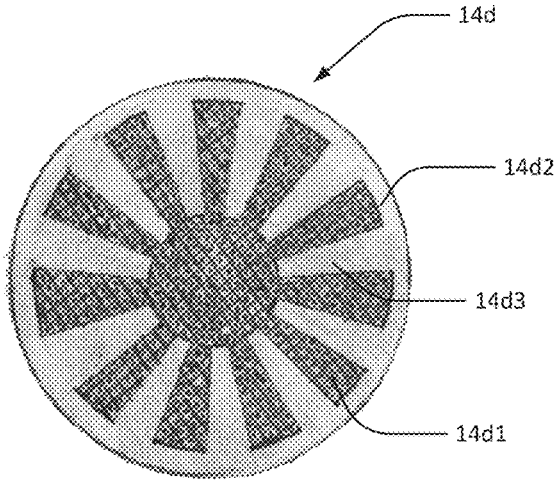
FIG. 5*d* is a top view of the upper locating member embodiment with flexible wings.

FIG. 5*d* shows an alternative embodiment of the chamber upper locating member 14*d* with cap receiving wings 14*d*3. Shown also is the sleeve 14*d*1 and mesh 14*d*2. The receiving wings function to softly receive the cigar, but to firmly hold the cigar in place centering it in the tube. This winged receiving cap, which holds the humidity control compound takes the place of what would otherwise be soft packing materials, which are incorporated to resist internal movement of the smoking product and thus the cigar band 8*a*, which is prone to sliding up and down the shaft of the cigar 8 on impact when the cigar is held too loosely inside a tube or pouch.

One advantage of the winged receiving cap 14*d* is that it eliminates the need for packing materials, which could be considered physically obtrusive and annoying to remove while also eliminating the visual distraction of such materials within the tube itself, improving the smoking product marketability by providing a superior overall visual presentation.

Figure 6A:
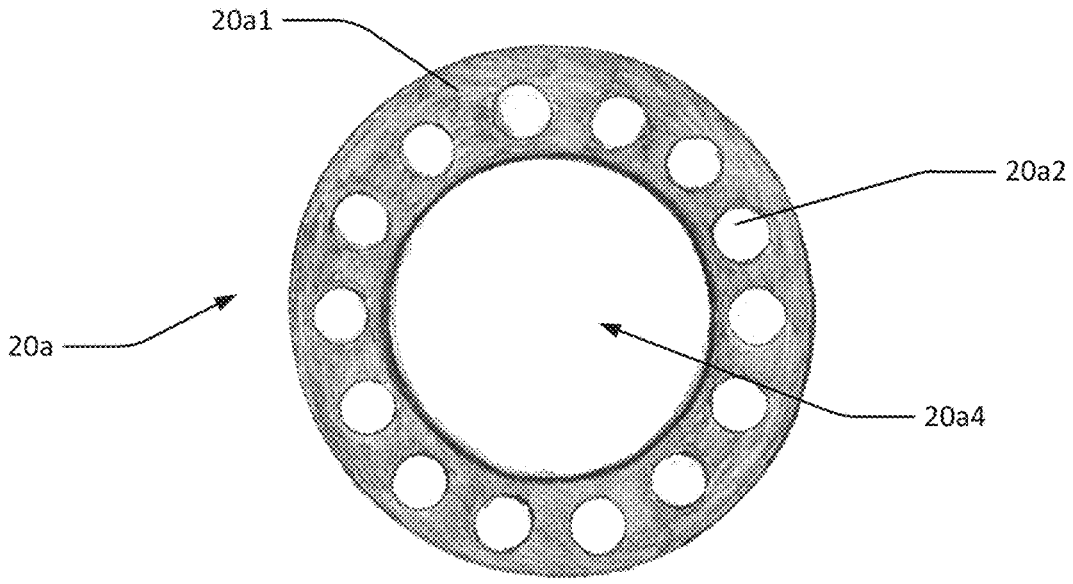
FIG. 6*a* is a top view of the stabilizing disc.
Figure 6B:
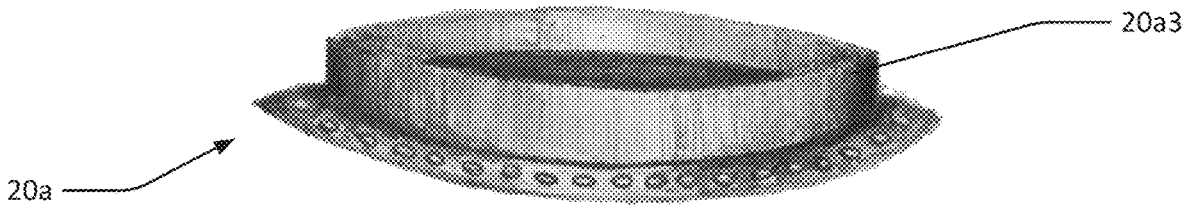
FIG. 6*b* a side view of the stabilizing disc with upright sleeve.

Near the bottom of the cigar tube is the stabilizing disc with upright sleeve 20*a* (also referred to as the lower locating member). A top and side view of one embodiment of this component is shown in FIGS. 6*a* and 6*b*. The stabilizing disc centers the cigar 8 in the tube by positioning the rounded end of the cigar into the sleeve 20*a*1 portion of the disc. The sleeve extends upwards from the circumference of the central hole and is surrounded by an annular ring portion of the disc. In the shown embodiment, the annular ring portion contains holes 20*b* for circulating the humidified air throughout the tube so that every surface of the cigar is exposed to humidified air.

Figure 6C:
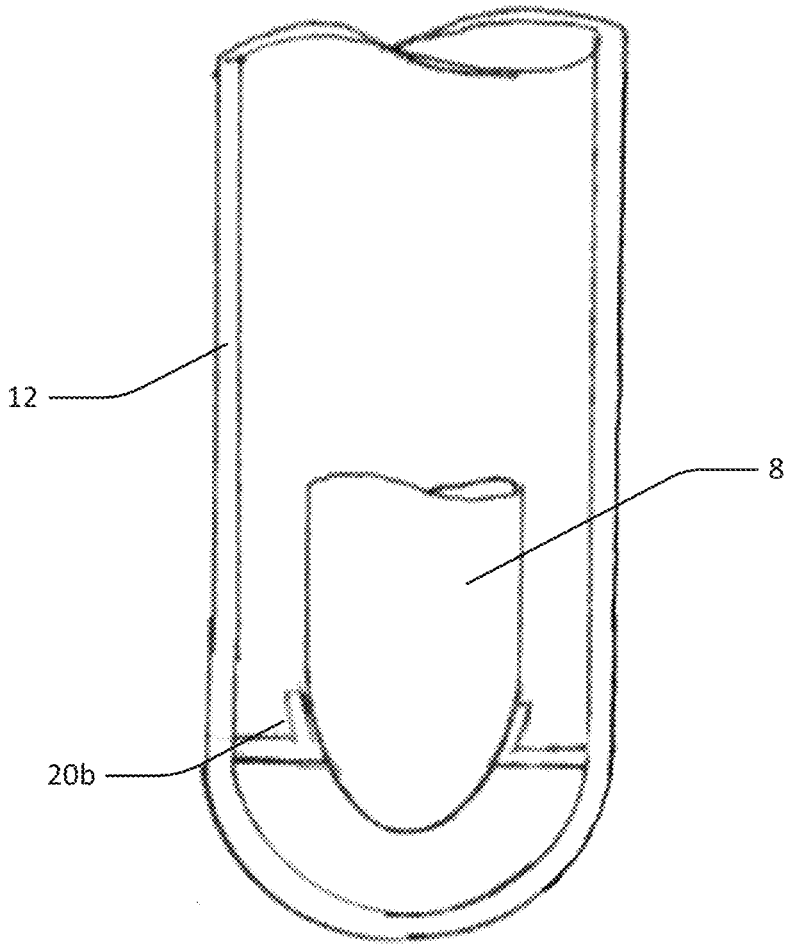
FIG. 6*c* is a cross section view of the bottom portion of the humidifying apparatus with upright sleeve and a cigar in stabilized position.
Figure 6D:
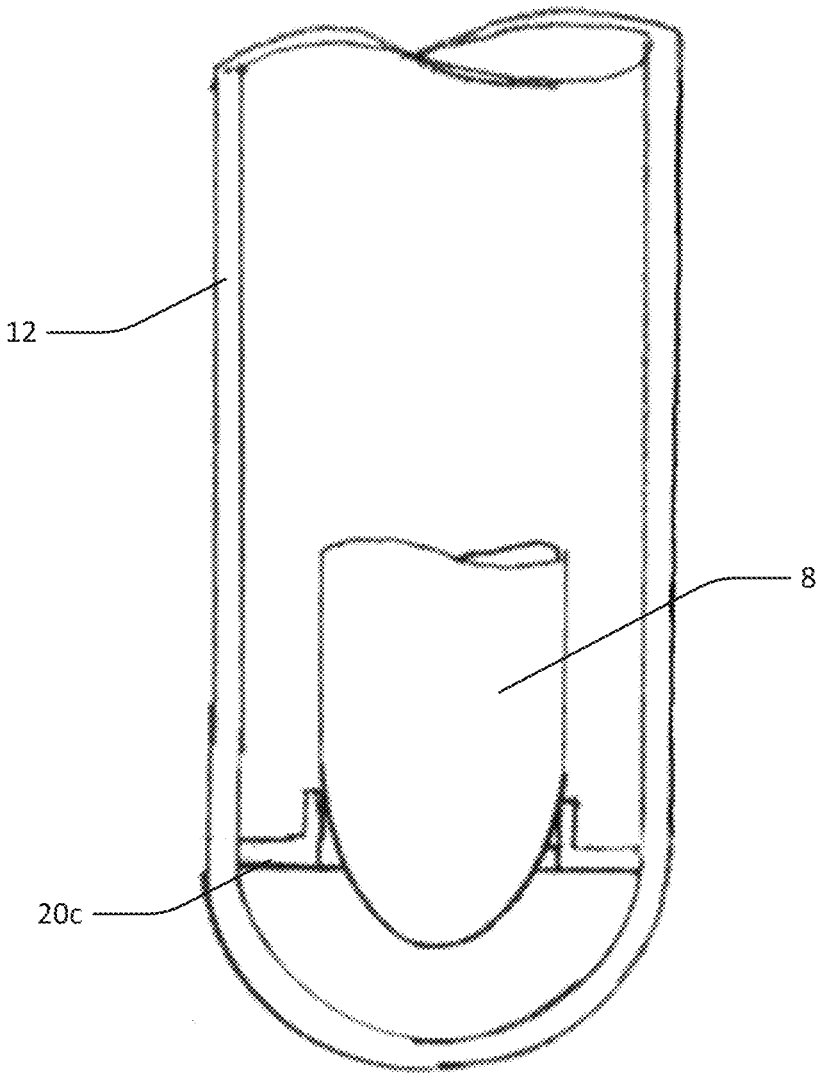
FIG. 6*d* is a cross section view of the bottom portion of the humidifying apparatus with upright sleeve and a cigar in stabilized position.
Figure 6E:
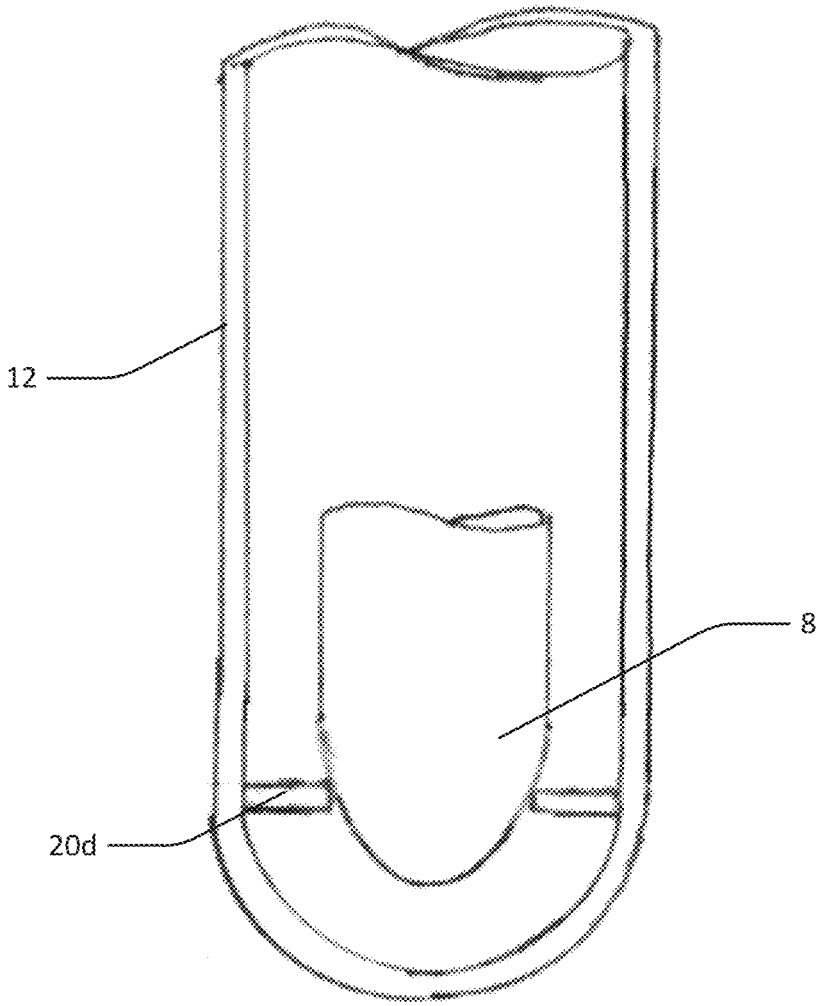
FIG. 6*e* is a cross section view of the bottom portion of the humidifying apparatus with upright sleeve and a cigar in stabilized position.
Figure 6F:
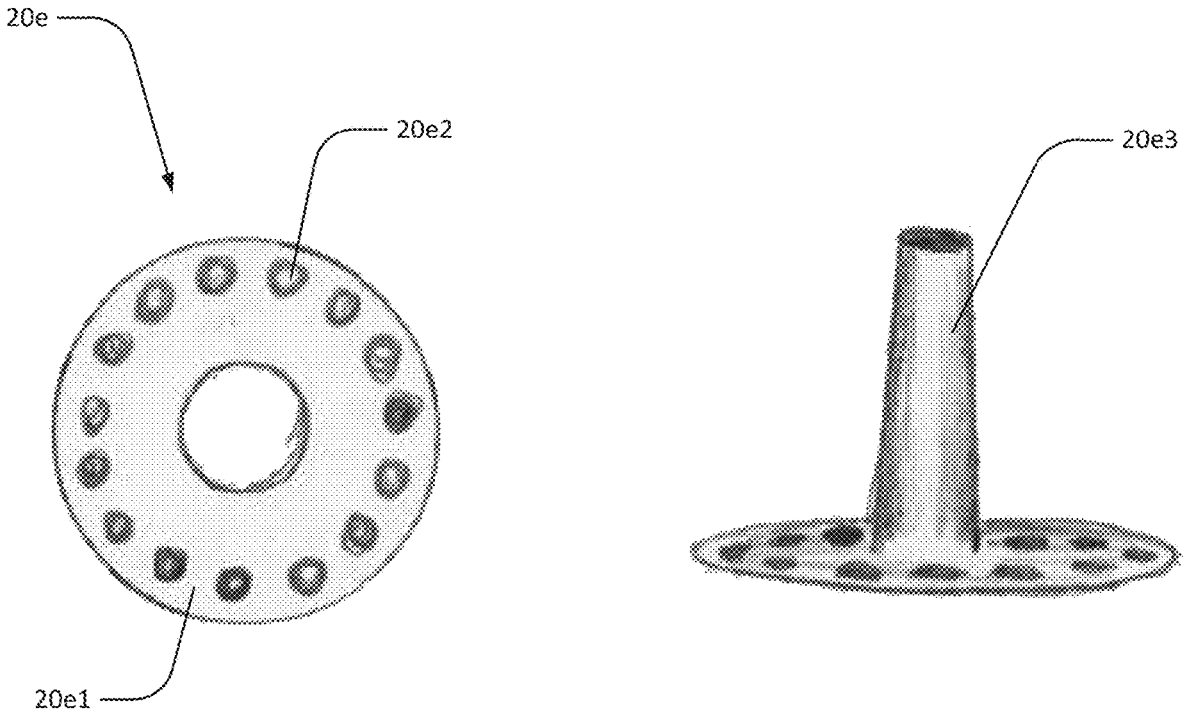
FIG. 6*f* shows the top and side views of an alternative stabilizing disc for cigars with a hole in the mouthpiece.
Figures 1, 6G:
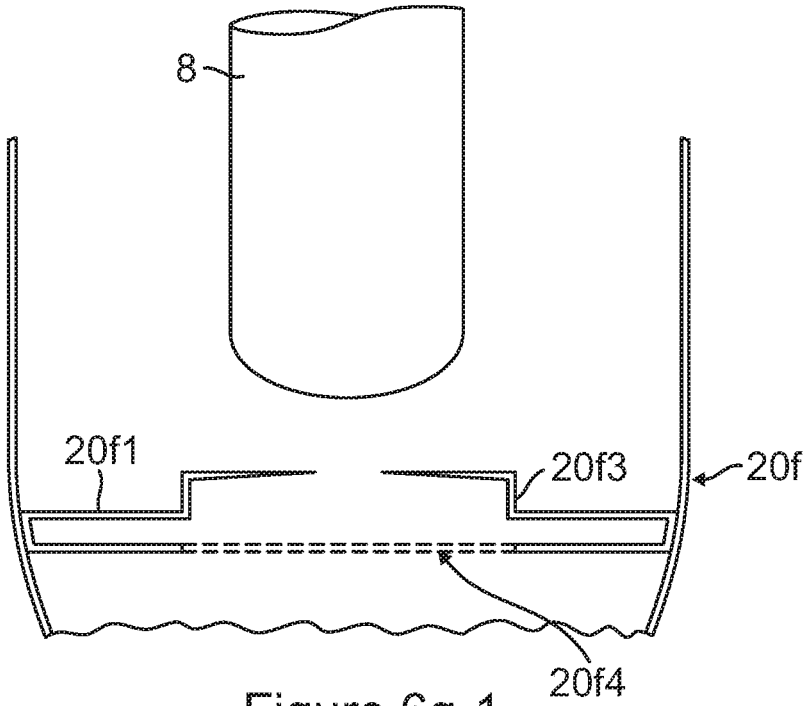
Figures 2, 6G:
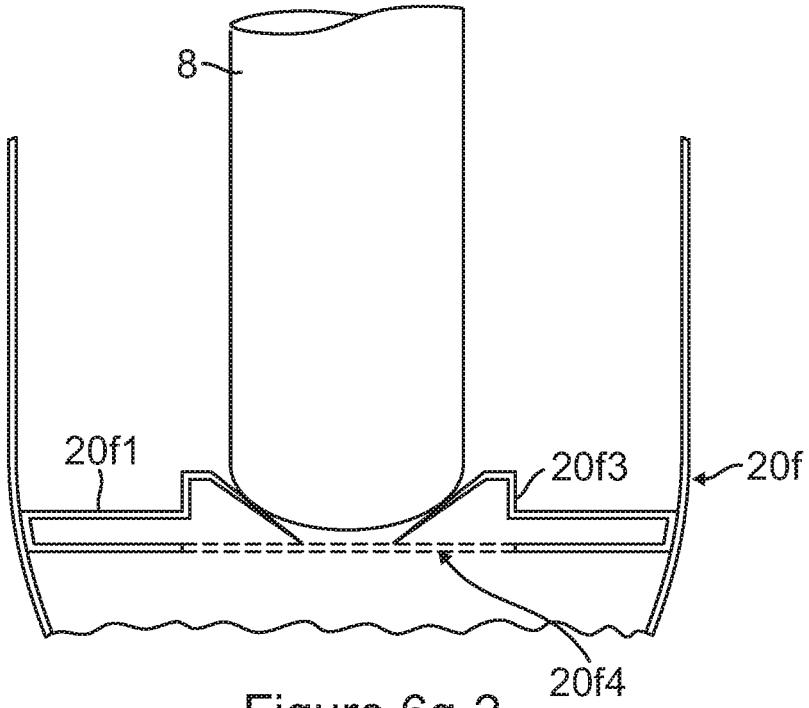
Figure 6H:
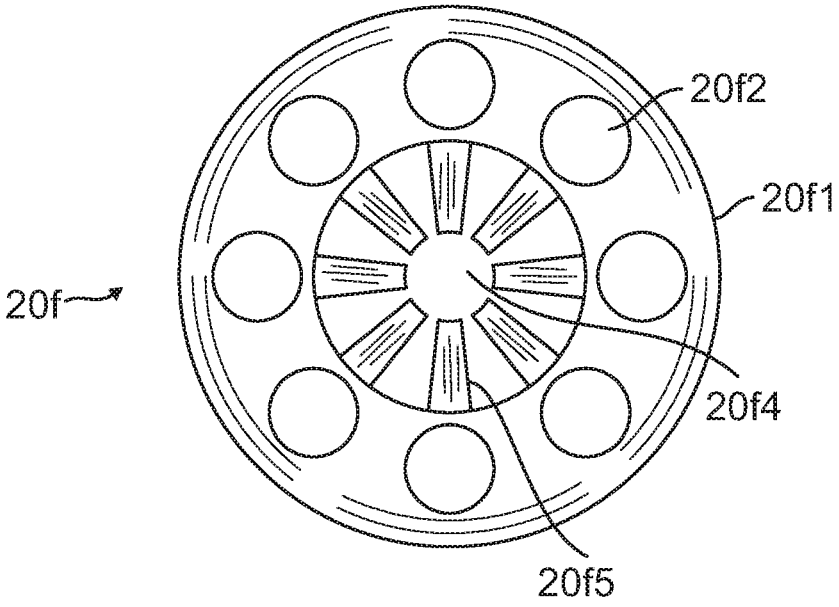
FIG. 6*h* is a top view of an alternative winged lower locating member or stabilizing disc.

FIGS. 6*c*-6*h* show cross sectional views of the lower portion of the apparatus tube showing four alternative embodiments of the stabilizing disc. FIG. 6*c* shows an alternative embodiment with a stabilizing disc where the sleeve is slanted upwardly and outwardly to mate with the rounded mouth end of the cigar. FIG. 6*d* shows an alternative embodiment with a stabilizing disc with a conical or vertically upstanding sleeve 20*c* FIG. 6*e* shows an embodiment in which the cap alone is used, with no sleeve. FIG. 6*f* shows an embodiment of a stabilizing disc with an upright stabilizing post 20*d* which can be used with cigars that have an opening at the inhaling end. In this embodiment, a cigar mouth opening is positioned onto a protrusion 26*a* extending upward from the disc and into the mouth opening of the cigar. FIGS. 6*g* and 6*h* show a fourth embodiment of the stabilizing disc or lower locating member 20*f* from a side cross section view and a top view. This embodiment utilizes a winged receiver, similar to the winged receiving cap detailed above. In FIG. 6*g*, the side cross section may be viewed, showing the elements including the cigar 8, annular ring 20*f*1, sleeve 20*f*3 and cigar hole 20*f*4. FIG. 6*h* shows the top view including the elements annular ring 20*f*1, ring holes 20*f*2, cigar hole 20*f*4 and receiving wings 20*f*5. This embodiment for the lower locating member has the same advantages as the winged receiving cap detailed above. When used in conjunction with each other, both winged components provide ideal shock absorption to optimally preserve the physical state of the cigar and the originally intended cigar band location.

Figure 7A:
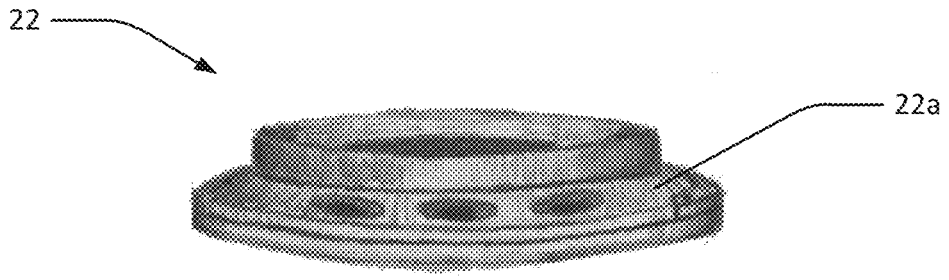
FIG. 7*a* shows a side view of the combination stabilizing disc with cutter assembly.
Figure 7B:
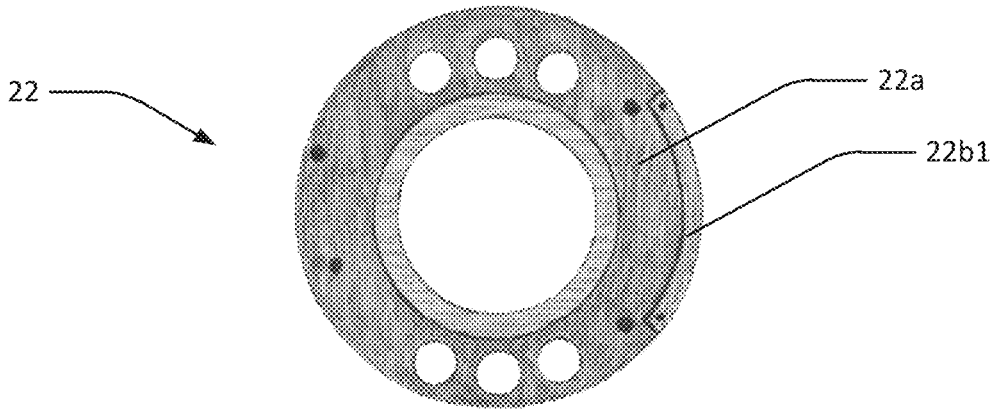
FIG. 7*b* shows a top view of the combination stabilizing disc with cutter assembly.
Figure 7C:
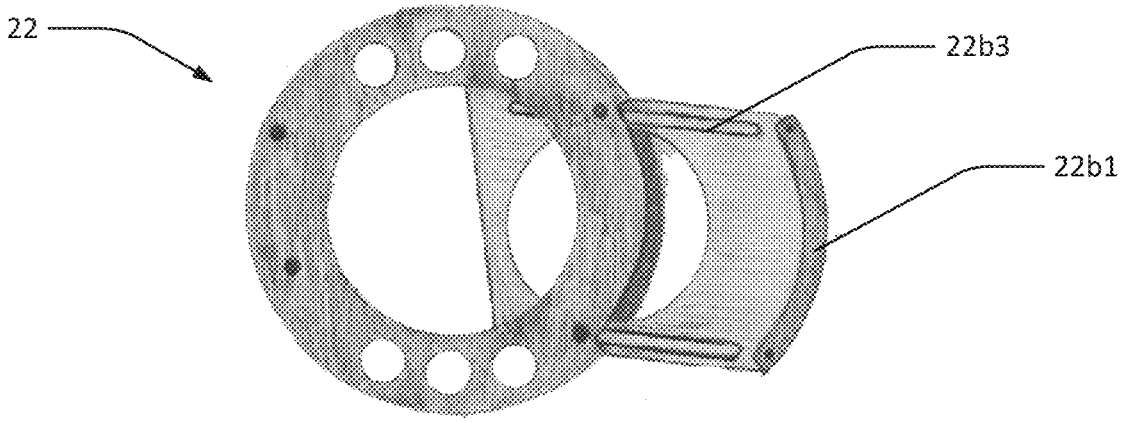
FIG. 7*c* shows a top view of the combination stabilizing disc with cutter assembly shown with the blade partially closed.

In certain embodiments, a miniature cigar cutter is integrated into the stabilizing disc. Two embodiments of such a stabilizing disc/cutter assembly are detailed in FIGS. 7-10. Both embodiment versions are configured by sandwiching 3 layers of the assembly: a top and base disc with a middle cutting blade plate which slides or pivots between the top and base discs. FIG. 7*a* shows the side view of the sliding cutting blade embodiment of the integrated stabilizing disc and cutting assembly 22. In this embodiment, the sleeve portion of the assembly is upright and straight. As previously described by FIGS. 6*c*-*e*, the stabilizing disc may have alternative embodiments with no sleeve or a conical section sleeve (slanted to mate with the rounded mouth end of the cigar) or a stabilizing post. FIG. 7*b* shows a top view of the integrated stabilizing and cutter assembly 22 in the closed position. A handle 22*b*1 of the cutting blade plate can be seen on the right side of the assembly. The ends of the blade guide posts 22*b*3 and blade stop posts 22*b*4 can be seen in FIG. 7*b*. FIG. 7*c* shows a top view of the stabilizing and cutter assembly 22 in the partially open position. In this view of assembly 22, the sliding cutting blade 22*b*2 and blade cutting edge 22*b*5, blade handle 22*b*1, and blade guide slots 22*b*3 are visible. The blade guide slots 22*b*3 guide the cutting blade as it slides between the top disc 22*a* and base disc 22*c*. To operate the assembly, after the cigar 8 and stabilizing disc and cutter assembly 22 are removed from the tube 12 by turning over the tube (the cigar and disc will fall out of the tube), a) the cutter blade 22*b*2 is slid to an open position, b) the cigar mouth end is placed back into the cigar hole in the center of the assembly and c) the cutter blade 22*b*2 cutting blade edge 22*b*5 is pushed through the mouth end of the cigar by a user pushing the blade handle 22*b*1.

Figure 8A:
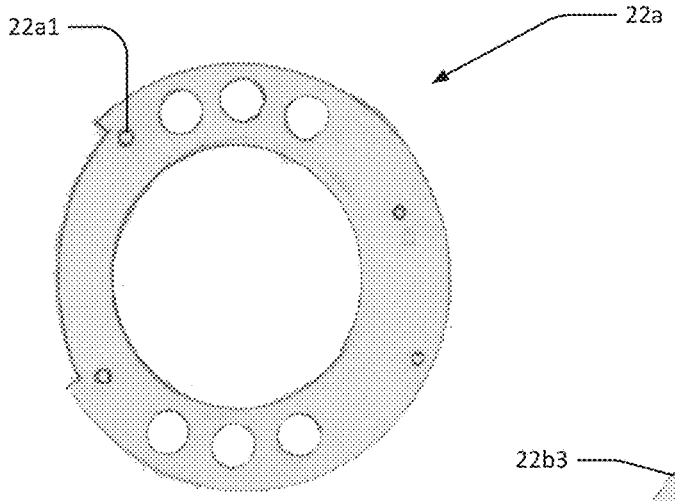
FIG. 8*a* shows a top view of the cigar stabilizer with cutter, top plate.
Figure 8C:
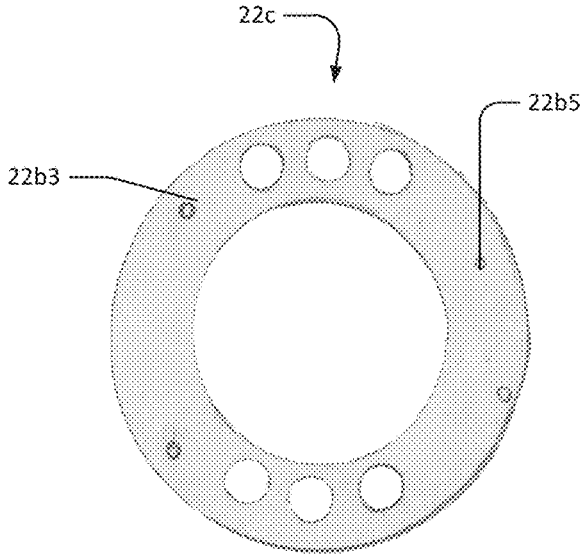
FIG. 8*c* shows a top view of the cigar stabilizer with cutter, blade plate.
Figure 8B:
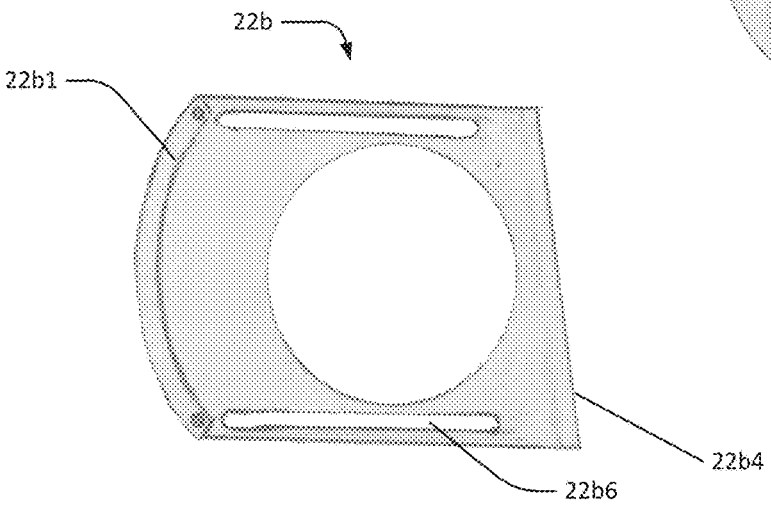
FIG. 8*b* shows a top view of the cigar stabilizer with cutter, bottom plate.

FIGS. 8*a*-*c* show top views of the 3 plate layers of the stabilizer and cutter assembly 22. Note that the orientation of the assembly and assembly plate layers are reversed from FIG. 7*a*-*c*. FIG. 8*a* shows a top view of the top plate 22*a*. A notch 22*a*2 for receiving the handle 22*b*1 of the sliding cutting blade plate can be seen on the left side of the plate. The end holes 22*a*1 which receive the blade guide posts 22*b*3 and blade stop posts 22*b*4 can be seen in FIG. 8*a*. FIG. 8*b* shows the cutting blade plate layer 22*b*. Shown in FIG. 8*b* is the sliding cutting blade plate 22 with components: sliding cutting blade 22*b*2 and blade cutting edge 22*b*5, blade handle 22*b*1, and blade guide slots 22*b*3. The blade guide slots 22*b*3 guide the cutting blade as it slides between the top disc 22*a* and base disc 22*c*. The base plate of the assembly 22*b* is shown in FIG. 8*c*.

Figure 9A:
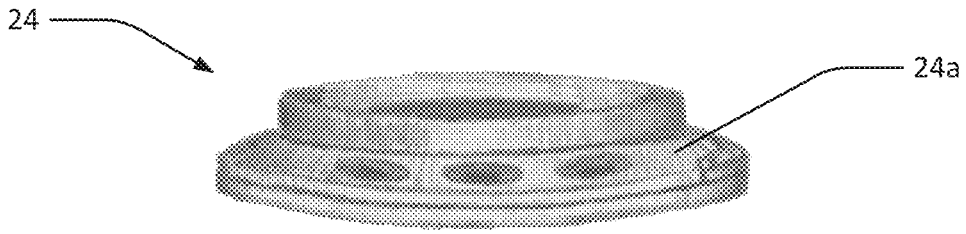
FIG. 9*a* shows a side view of an alternative embodiment of the combination stabilizing disc with cutter assembly.
Figure 9B:
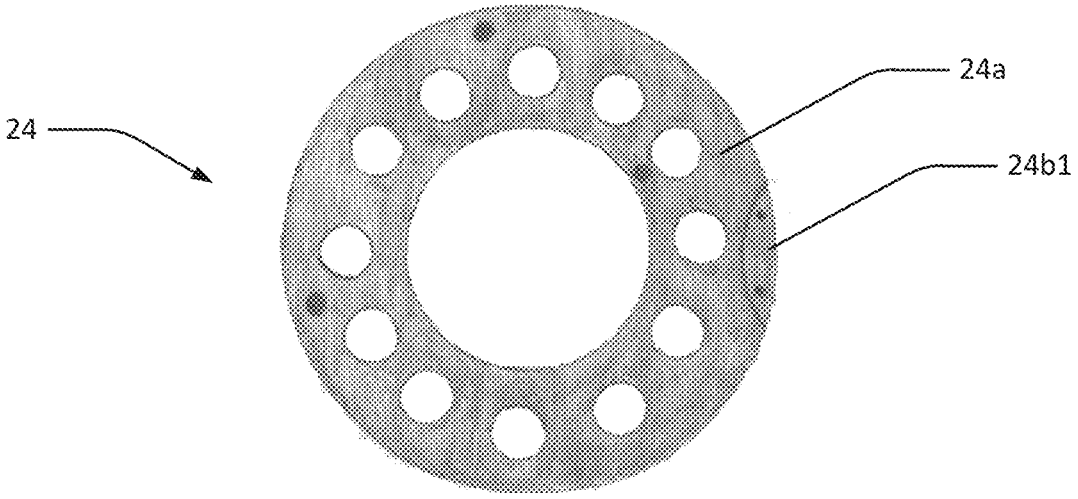
FIG. 9*b* shows a top view of an alternative embodiment of the combination stabilizing disc with cutter assembly.
Figure 9C:
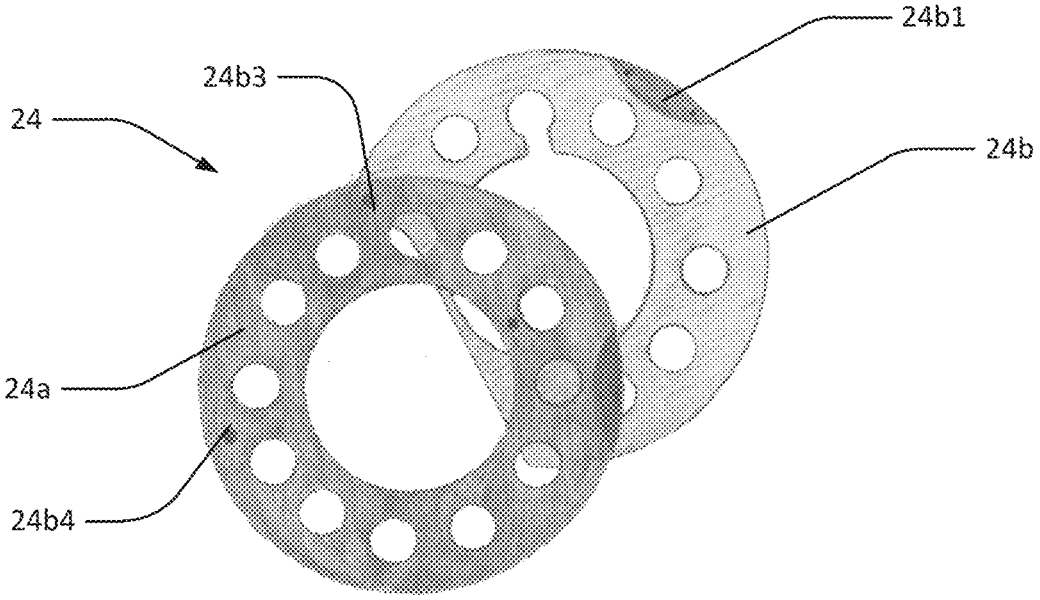
FIG. 9*c* shows a top view of an alternative embodiment of the combination stabilizing disc with cutter assembly shown with the blade partially closed.

FIG. 9*a*-*c* show an embodiment of the stabilizing and cutter assembly 24 where a cutting blade plate 24*b* pivots between the top and base plates 24*a* and 24*c* respectively of the assembly. FIG. 9*a* shows the side view of the pivoting cutting blade embodiment of the integrated stabilizing disc and cutting assembly 24. In this embodiment, the sleeve portion of the assembly is upright and straight. As previously described by FIGS. 6*c*-*e*, the stabilizing disc may have alternative embodiments with no sleeve or a conical section sleeve (slanted to mate with the rounded mouth end of the cigar) or stabilizing posts. FIG. 9*b* shows a top view of the integrated stabilizing and pivot cutter assembly 24 in the closed position. A handle 24*b*1 of the cutting blade plate can be seen on the right side of the assembly. The ends of the blade pivot post 24*b*3 (or hinge point) and blade stop post 24*b*4 can be seen in FIG. 9*b*. FIG. 9*c* shows a top view of the stabilizing and cutter assembly 24 in the partially open position. In this view of assembly 24, the pivot cutting blade 24*b*2 and pivot blade cutting edge 24*b*5, and blade handle 24*b*1 are visible. To operate the assembly, after the cigar 8 and stabilizing disc and pivot cutter assembly 24 are removed from the tube 12 by turning over the tube (the cigar and disc will fall out of the tube), a) the cutter blade 24*b*2 is pivoted to an open position, b) the cigar mouth end is placed back into the cigar hole in the center of the assembly and c) the cutter blade 24*b*2 cutting blade edge 24*b*5 is pushed through the mouth end of the cigar by a user pushing the blade handle 24*b*1. In this embodiment, the pivot cutter blade 24*b*3 pivots around the blade pivot post 24*b*, which acts as a single hinge point for the blade as it slides between the top plate 24*a* and base plate 24*c*.

Figure 10A:
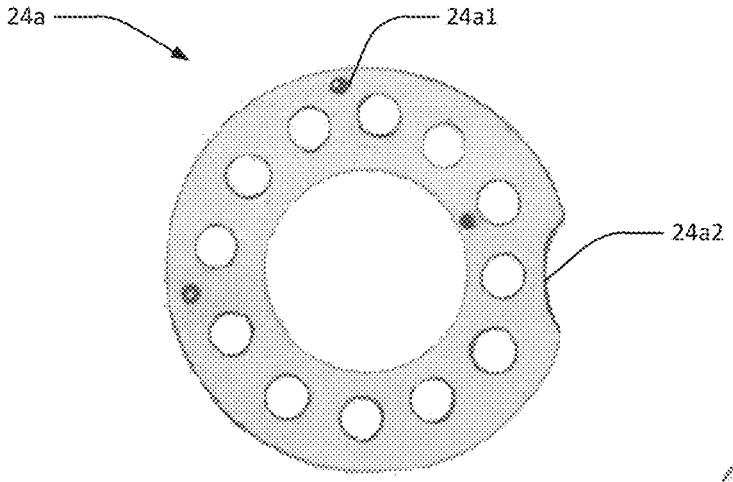
FIG. 10*a* shows a top view of an alternative embodiment of the cigar stabilizer with cutter, top plate.
Figure 10C:
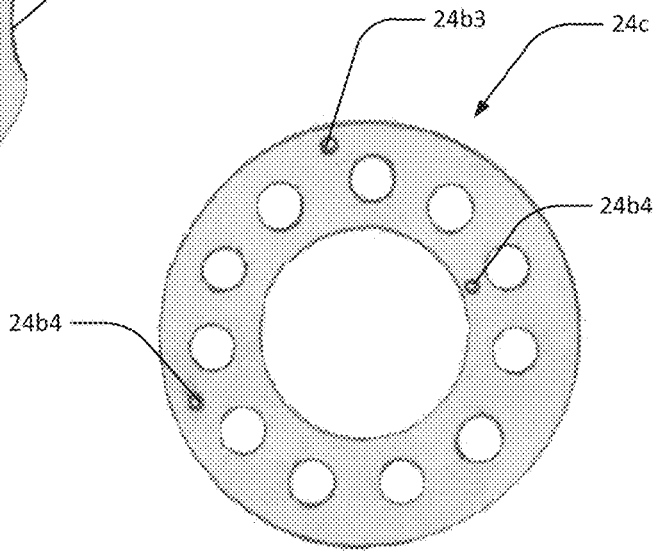
FIG. 10*c* shows a top view of an alternative embodiment of the cigar stabilizer with cutter, blade plate.
Figure 10B:
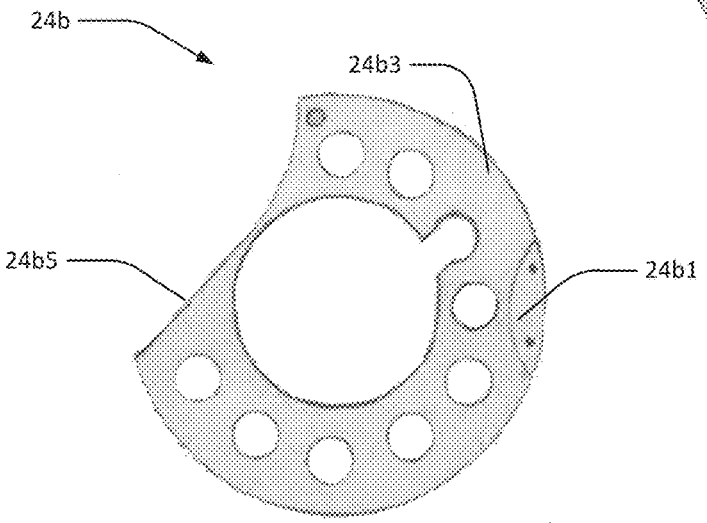
FIG. 10*b* shows a top view of an alternative embodiment of the cigar stabilizer with cutter, bottom plate.

FIGS. 10*a-c* show top views of the 3 plate layers of the stabilizer and pivot cutter assembly 24. FIG. 10*a* shows a top view of the top plate 24*a*. A notch 24*a*2 for receiving the handle 24*b*1 of the pivoting cutting blade plate 24*b* can be seen on the left side of the plate 24*a*. The end holes 24*a*1 which receive the blade pivot post 24*b*3 (or hinge point), and blade stop post 24*b*4 can be seen in FIG. 10*a*. FIG. 10*b* shows the pivot cutting blade plate layer 24*b*. Shown in FIG. 10*b* is the pivot cutting blade plate 24*b* with components: pivot cutting blade 24*b*2 and pivot blade cutting edge 24*b*5, and pivot blade handle 24*b*1. The base plate 24*c* of the assembly 24 is shown in FIG. 10*c*.

Manufacture of the Apparatus

All components of the apparatus (other than the humidity control packet) may be constructed of molded plastic. The sealing and humidity control chamber as well as the upper locating member component along with the stabilizing disk and sleeve component are produced from molded plastic to create the primary items. They are made using a plastic injection mold apparatus. After these components are created, the two-way humidity control packet is inserted in the sealing cap & humidity control chamber component. The upper locating member, which seals the humidity control packet inside the humidity control chamber can be sealed with adhesive or a tongue & grove type fitting, which allows the male end of the sleeve & cap to be snapped into the female end of the humidity control chamber. Once these pieces are assembled, the stabilizing disk and sleeve component is placed inside the cigar tube, followed by the cigar, which is followed by the preassembled humidity control unit that is pressed or screwed down until sealed. In various embodiments, a glass cigar tube can be hand made by a glass blower or made from a glass-molding device. It is obviously pre-existing technology and can be procured from almost any test-tube manufacturer. The two-way humidity control packet typically contains a salt compound and a thickening compound. A currently available source for such packets is the Boveda company.

In an alternative embodiment nitrogen may be added to the tube chamber to enhance preservation of the cigar in a two-way humidity controlled, nitrogen sealed cigar tube. In various embodiments, the sealing lid provides a hermetic seal.

In alternate embodiments, the walls of the breathable chamber may be constructed of fabric or woven metal. In an alternate embodiment, a small pin could also be attached to the center of the upper locating member, which would be inserted into the cigar. This variation improves and simplifies centering the cigar to mate with the sleeve ends during assembly and may aid in the overall stability of cigar within the apparatus.

In an alternate embodiment, a second breathable chamber is located on the opposite end of the tube, and the tube may be opened or closed from either end.

In an alternate embodiment, the apparatus features a centrally stabilizing, breathable, rigid mesh, cylindrical chamber within the tube. Between the walls of the tube and this rigid mesh chamber, one could insert two-way humidity control packets to surround the cigar. Inside the rigid mesh chamber would only be the centrally stabilized cigar, which would be segregated from the two-way humidity control packets. Stabilizing sleeves on the top and bottom of the tube could also be added to this configuration.

In an alternate embodiment, the bottom (mouth end) of the cigar is stabilized by a holding point integrated into the structure of the tube itself.

In an alternate embodiment, the centralized stabilization of the cigar could also be achieved from multiple points of support connected to walls of the tube and resting upon the cigar itself.

In an alternate embodiment, a free-floating, separate cylindrical humidity control chamber component could be placed inside the tube. This component could also feature a stabilizing sleeve and the cigar could be held in place by the closing pressure of the cap.

In an alternate embodiment, the container vessel may be an elongated cuboid or any other hollow shaped container which is capable of incorporating corresponding components detailed in the above disclosed embodiments.

In an alternate embodiment, the breathable chamber portion of the apparatus may protrude outwardly from the vessel instead of being inserted.

In an alternate embodiment, a vapor permeable membrane lines the inside of the vessel and is filled with a two-way humidity controlling compound.

In an alternate embodiment, rods are placed within the tube, surrounding the cigar to create breathable passages for the two-way humidity controlled air to circulate throughout the tube.

As used herein, the term "cigar" is generically defined as any consumer smoking product which is lit at one end of the product, and from which smoke is inhaled from the other end. Various organic materials may comprise the entirety of the product, or the product may be constructed of multiple burnable products including organic core material and a burnable wrapping material, such as a cigarette. Any organic material which is smoked by consumers may comprise the core of the product, such as tobacco or cloves.

What has been described herein is considered merely illustrative of the principles of this invention. Accordingly, it is well within the purview of one skilled in the art to provide other and different embodiments within the spirit and scope of the invention.

The invention claimed is:

1. An apparatus for packaging and storing an elongated cylindrical smoking product in a humidity controlled vessel comprising:

a. a hollow cylindrical tube container vessel that is self supporting and is open at one end and closed at the opposite end and is sized to contain the smoking product and having a diameter relative to the diameter of the smoking product that is sufficient to provide space surrounding the smoking product for circulating humidified gas about an outer surface of the smoking product;

b. a sealing cap assembly comprising:

i. a sealing lid;

ii. a vapor permeable chamber affixed at an upper end to the sealing lid and comprising a frame defining an interior space and having a vapor permeable membrane affixed interiorly to the frame wherein humidity control compound is contained within the interior space whereby humidified gas is able to exit the vapor permeable chamber through the vapor permeable membrane and pass into the container vessel;

iii. an upper locating member affixed to an end of the vapor permeable chamber opposite to the sealing lid wherein the upper locating member is configured to accept a cut end of the smoking product so as to be sufficiently centered within the hollow cylindrical tube container vessel so as to provide space surrounding the smoking product for circulating humidified gas about the outer surface of the smoking product;

c. a lower locating member fitted adjacent the closed end of the hollow container vessel comprising a stabilizing disc comprising an annular ring having holes around it and a central hole to accept an end of the smoking product to fit into the central hole of the annular ring and being sufficiently centered within the hollow container vessel so as to provide space surrounding the smoking product for circulating humidified gas about the outer surface of the smoking product;

whereby when a smoking product is affixed between the upper locating member and the lower locating member and the sealing cap assembly is fixed to the open end of the hollow container vessel to establish a sealed closure of the top of the hollow tube, with the vapor permeable chamber inside the hollow tube optimally humidified gas may circulate freely around the outer surface of the smoking product and the smoking product is protected against physical damage by the upper locating member and the lower locating member.

2. The apparatus of claim 1 wherein the smoking product is a cigar.

3. The apparatus of claim 1 wherein the humidified gas comprises oxygen and water vapor.

4. The apparatus of claim 1 wherein the stabilizing disc is a combination stabilizing disc and smoking product cutter assembly comprising a top plate; a cutter blade plate; and a base plate.

5. The apparatus of claim 4 wherein the cutter blade plate slides linearly between the top plate and the base plate.

6. The apparatus of claim 4 wherein the cutter blade plate pivots between the top plate and the base plate by a single hinge point.

7. The apparatus of claim 1 wherein the upper locating member further comprises an upper opening in communication with the chamber and installed in the upper opening is a vapor permeable disc.

8. The apparatus of claim 7 wherein the upper locating member further comprises an annular ring of flexible wings extending inwards from a circumference of the member towards a center of the disc, whereby the annular ring of flexible wings are resiliently fixed around the outside circumference of the smoking product to retain it centrally within the upper locating member and thereby to place it centrally within the hollow containing vessel and providing absorption of shock being transmitted to the smoking product upon any striking of the hollow tube vessel and the lower locating member further comprises a set of resilient flexible wings extending inwards from the annual ring thereby to retain the smoking product centrally within the hollow containing vessel and providing absorption of shock whereby the combined effect of the upper locating member wings and the lower locating member wings is to provide optimal shock absorption and central locating.

9. A method for packaging and storing an elongated cylindrical smoking product in a humidity controlled vessel comprising:

a. placing the smoking product into a hollow cylindrical tube container vessel that is self supporting and is open at one end and closed at the opposite end and is sized to contain the smoking product and having a diameter relative to the smoking product that is sufficient to provide space surrounding the smoking product for circulating humidified gas about an outer surface of the smoking product;

b. fitting the smoking product against a lower locating member fitted adjacent the closed end of the hollow container vessel comprising a stabilizing disc comprising an annular ring having holes around it and a central hole accepting an end of the smoking product fitted into the central hole of the annular ring and being sufficiently centered within the hollow container vessel so as to provide space surrounding the smoking product for circulating humidified gas about the outer surface of the smoking product;

c. fixing a sealing cap assembly onto the open end of the hollow container vessel, wherein the sealing cap assembly comprises:

i. a vapor permeable chamber affixed at an upper end to the sealing lid the vapor permeable chamber comprising a frame defining an interior space and having a vapor permeable membrane affixed interiorly to the frame wherein humidity control compound is contained within the interior space whereby humidified gas is able to exit the vapor permeable chamber through the vapor permeable membrane and pass into the container vessel;

ii. an upper locating member affixed to an end of the vapor permeable chamber opposite to the sealing lid wherein the upper locating member is configured to accept a cut end of the smoking product so as to be sufficiently centered within the hollow cylindrical tube container vessel so as to provide space surrounding the smoking product for circulating humidified gas about the outer surfaces of the smoking product;

whereby when the smoking product is fitted between the upper locating member and the lower locating member and the sealing cap assembly is fixed to the open end of the hollow container vessel so that the apparatus is sealed, and the vapor permeable chamber is configured to contain humidity control compounds so that optimally humidified gas may circulate freely around the outer surface of the smoking product and the smoking product is protected against physical damage.

10. The method of claim 9 wherein the smoking product is a cigar.

11. The method of claim 9 wherein the humidified gas comprises oxygen and water vapor.

12. The method of claim 9 wherein the lower locating member is a combination stabilizing disc and smoking product cutter assembly comprising a top plate; a cutter blade plate; and a base plate.

13. The method of claim 12 wherein the cutter blade plate slides linearly between the top plate and the base plate.

14. The method of claim 12 wherein the cutter blade plate pivots between the top plate and the base plate by a single hinge point.

15. The method of claim 9 wherein the upper locating member further comprises a vapor permeable disc and a protruding sleeve around the circumference of the vapor permeable disc.

16. The method of claim 15 wherein the upper locating member further comprises an annular ring of flexible wings extending inwards from the circumference of the disc towards the center of the disc, whereby the annular ring of flexible wings provide structural strength with flexibility and the lower locating member further comprises a set of resilient flexible wings extending inwards from the annual ring thereby to retain the smoking product centrally within the hollow containing vessel and providing absorption of shock whereby the combined effect of the upper locating member wings and the lower locating member wings is to provide optimal shock absorption and central locating.

* * * * *